United States Patent [19]

Halloran et al.

[11] 4,151,869

[45] May 1, 1979

[54] KNIFE ASSEMBLY FOR PROFILE CUTTING HEAD

[75] Inventors: John E. Halloran, Big Rapids; Leward N. Smith, Remus, both of Mich.

[73] Assignee: Michigan Knife Co., Big Rapids, Mich.

[21] Appl. No.: 853,387

[22] Filed: Nov. 21, 1977

[51] Int. Cl.[2] ..... B27G 13/00; B26D 1/12

[52] U.S. Cl. ..... 144/230; 407/46; 407/48; 407/101; 407/104; 144/218

[58] Field of Search ..... 407/31, 33, 46, 48, 407/49, 61, 66, 101, 103, 115, 120, 108, 104; 144/218, 231, 230, 237, 241, 225, 228, 229, 230

[56] References Cited

U.S. PATENT DOCUMENTS

| | | | |
|---|---|---|---|
| 1,299,125 | 4/1919 | Carter | 407/120 |
| 1,368,070 | 2/1921 | Stone | 407/120 |
| 2,521,868 | 9/1950 | Otto | 407/48 |
| 3,487,865 | 1/1970 | Chapman et al. | 144/237 |
| 3,775,817 | 12/1973 | Hertel | 407/101 |
| 3,838,724 | 10/1974 | Buchacher et al. | 144/230 |
| 3,865,164 | 2/1975 | Sybertz | 144/230 |
| 4,009,742 | 3/1977 | Ziegelmeyer | 144/218 |

*Primary Examiner*—Harrison L. Hinson

*Attorney, Agent, or Firm*—Price, Heneveld, Huizenga & Cooper

[57] ABSTRACT

A knife for a log profile cutting head assembly is detachably secured to a base including a chip directing gullett which in turn is secured to a standard cutting disc. The removable knife is shaped to include a mounting surface oriented to maximize resistance of the knife to forces encountered and includes rectilinear cutting edges which can be sharpened on conventional grinders. A grinding guide integral with the knife and positioned between one cutting surface and the mounting surface overlaps the interface of the knife and base to prevent chip jamming.

6 Claims, 5 Drawing Figures

KNIFE ASSEMBLY FOR PROFILE CUTTING HEAD

BACKGROUND OF THE INVENTION

The present invention relates to improved knives for use in the lumber industry and particularly to a replaceable knife for a profile cutter.

In lumber mills, a log is debarked and shaped for subsequent cutting into dimensional lumber by a profile cutter. U.S. Pat. No. 3,457,974, issued on July 29, 1969, to L. A. Mitten, is representative of such a machine which includes means for controllably feeding a log into the cutting area which has several cutting heads, each of which in turn includes a plurality of cutting discs having removably mounted thereon a cutter knife.

Cutter knives of the prior art include cutting edges integral with a base including a curved gullett for directing wood chips away from the knife edge for removal from the machine. The feed means are specifically designed to prevent the cutting heads from their tendency to pull the tree through the machine at the speed of the cutting heads.

Several problems exist with profile cutters primarily directed to the knives which as can be appreciated are subject to intensive forces during the wood clipping process. Typically, knives wear only for a short period of time, not infrequently five hours or less. The integral knife and base construction of the prior art thus requires frequent sharpening of the knife edges. Inasmuch as the knife and base with a chip directing gullett are integral, regrinding of the knife edge also requires the gullett to be reground to maintain the predetermined relationship therebetween for proper chip removal. The time required for grinding both the knife edges and the gullett is extensive requiring skilled craftsmen and specialized grinding apparatus costing several thousand dollars as well as the necessary custom holders for securing the cutters to the grinding apparatus.

In an effort to overcome some of the difficulties of these machines, the industry has made intensive, heretofore unsuccessful, efforts to provide a knife assembly by which a replaceable knife is separately attached to a base which includes the gullett such that the knife removal can be expedited and the grinding operation simplified. One such effort is represented by U.S. Pat. No. 3,817,305, issued on June 18, 1974, to Wallace E. Gibbs. The structure represented by this prior art, however, requires a special knife holder and a curved knife, both of which in turn require specialized cutting discs which are assembled to form the cutter head. Thus, conversion of the profile cutter requires in essence an entirely new head to incorporate the replaceable knife feature of this prior art patent. As can be appreciated, this is an expensive proposition, and the curved knife has a relatively thin construction and is subject to failure due to crushing forces encountered when a tree inadvertently slips in the machine.

The machine's log feeding assemblies unavoidably permit some slippage of the logs. It has commonly been believed that this slippage caused shearing forces on the knifes which tore them apart. This belief led to the construction of the prior art which either did not provide replaceable knifes or provide a complex replaceable knife designed to resist shearing forces. After considerable experimentation it was discovered that logs jam against the knifes, and the knifes in fact fail due to a tremendous compressive or crushing force. Under such forces, the knives can be broken or deformed causing an unbalance of the cutting head assembly which can result in excessive vibrations causing even further machinery wear. During a typical operation, the conventional machines must be shut down frequently for repairs and knife replacement. This discovery led to the improved design of the present invention.

SUMMARY OF THE INVENTION

The present invention overcomes the difficulty of the conventional profile cutter and the prior art by providing both a practical knife for a cutter assembly which is easily replaceable, durable, and directly adapted to existing profile cutter machines. Apparatus embodying the present invention includes a removable knife blade, having a mounting surface oriented with respect to a pair of intersecting rectilinear cutting surfaces at an acute angle to the direction of rotation of the knife. The knife includes means for fastening it to a gulletted base.

According to one aspect of the invention, a grinding guide is formed between one of the knife surfaces and the mounting surface for indicating when the knife has been spent by successive sharpening. The guide overlies the junction of the knife and base and thus serves the additional function of shielding the junction from wood jamming between the knife and base.

In one embodiment of the invention, the means for fastening the knife to the base includes tapered aperture means and correspondingly shaped fasteners for self-aligning of the knife to the base and for minimizing stress concentration.

DETAILED DESCRIPTION OF THE PREFERRRED EMBODIMENT

Figure 1:
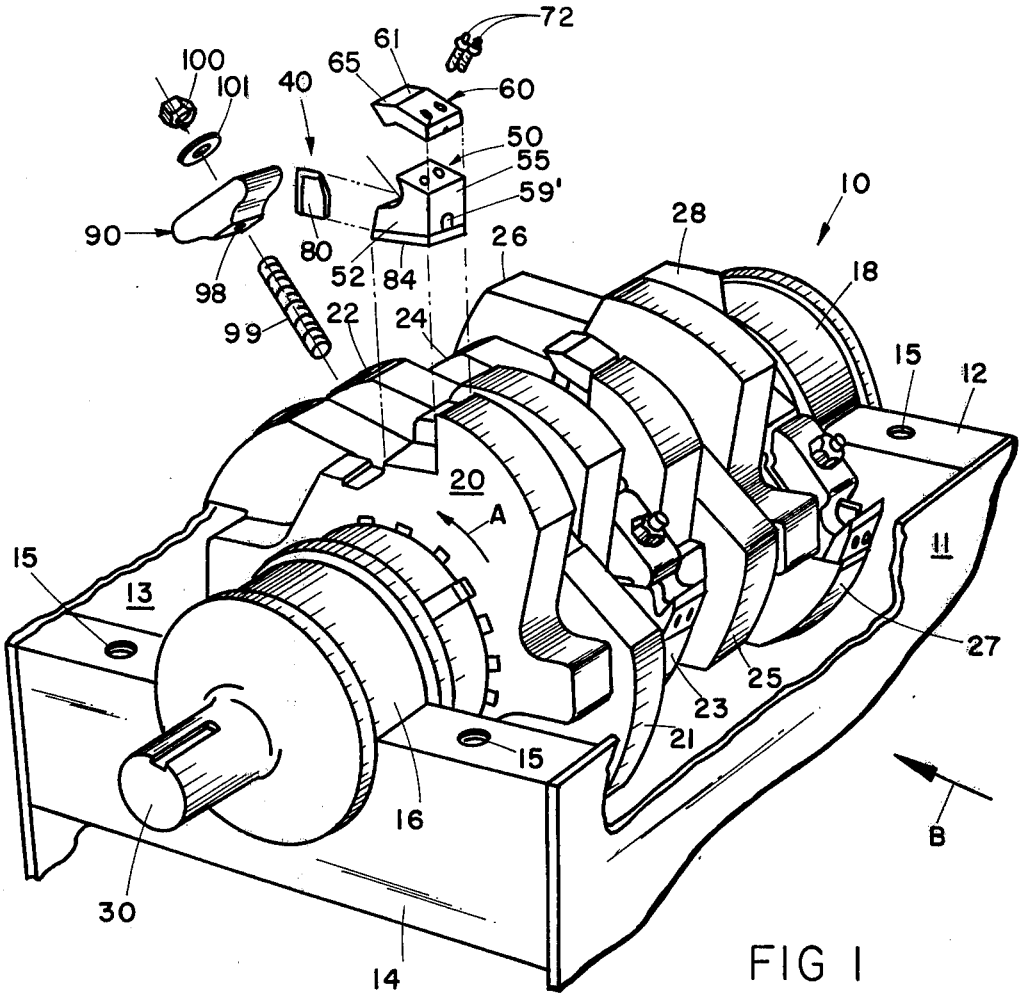
FIG. 1 is a fragmentary perspective view partly exploded of a cutter head assmebly for a profile machine embodying the present invention.

Referring now to FIG. 1 there is shown a cutter head assembly 10 which includes a mounting box having side walls 11 and 13 and end plates 12 and 14 for supporting therein bearings 16 and 18 for the rotatable cutting head. In FIG. 1 only the lower halves of walls 12 and 14 are shown, it being understood that upper walls are positioned to circumscribe bearings 16 and 18 and secured by bolts into threaded apertures 15. The cutter head assembly includes, in the embodiment shown, eight individual cutting discs 20 through 28 mounted on a splined drive shaft 30.

The cutting head assembly shown in FIG. 1 is one of several employed in the profile cutting machine suitably mounted to the frame of the machine in position to chip away the bark and a portion of the wood for cutting a log into a generally rectilinear profile for subsequent sawing into dimension lumber. Suitable drive means are coupled to the splined drive shaft 30 for rotating the cutting head assembly in a counter clockwise direction as indicated by arrow A to chip at the surface of a log fed to the cutter head in a direction indicated by arrow B in the FIG. The overall construction of the profile cutter is disclosed by the above identified U.S. Pat. No. 3,457,974, the disclosure of which is incorporated herein by reference.

Figure 2:
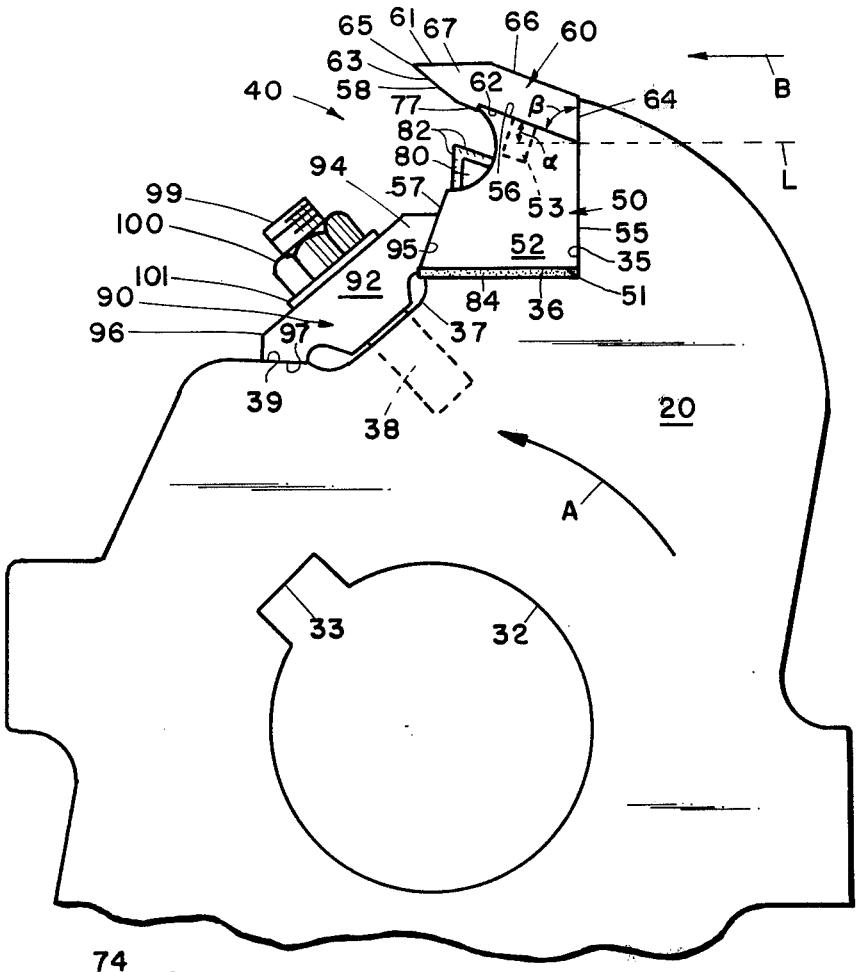
FIG. 2 is a fragmentary side elevational view of one of the cutter discs shown in FIG. 1.
Figure 3:
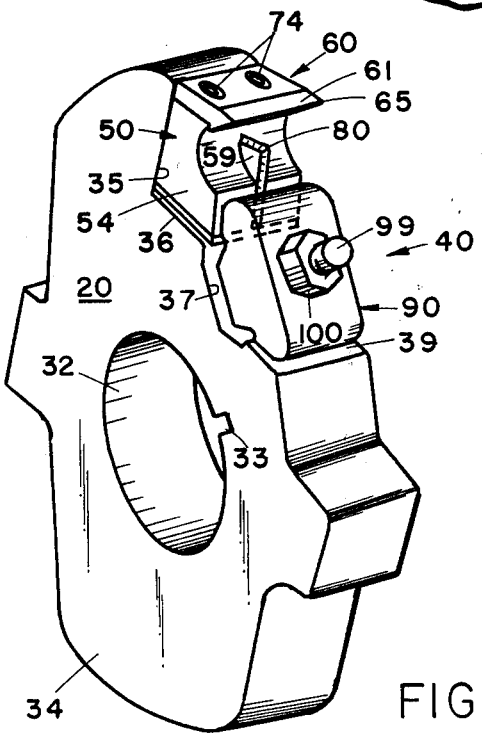
FIG. 3 is a perspective view of the disc shown in FIG. 2.

Each of the discs of the cutter head assembly includes as best seen in FIG. 2, a central aperture 32 which is keyed by keyway 33 to lock on axle 30. The cutters are generally formed of approximately 2 in. thick steel plate with spacers (not shown) between individual cutting discs. The discs are mounted in staggered relationship to each other such that the cutter head assemblies 40 mounted thereto successively contact the log as shaft 30 is rotated. Each of the cutting discs are generally elongated in side elevational view with an enlarged end 34 defining a counterweight opposite the cutter assembly 40. The cutting disc 20 shown in FIGS. 2 and 3 includes a configured step-cut machined surface for receiving the cutter assembly. The cutter receiving surfaces include a first longitudinally extending backing surface 35, a first floor surface 36, a concavely curved bolt receiving surface 37 having a threaded operture 38 therein, and a second floor surface 39 all formed in the end of the disc opposite counterweight 34. The cutter assemblies 40 mounted to the cutter discs includes a base assembly 50, a knife 60 detachably secured to base 50, and a clamp 90 for securing the base and knife in position on the cutter head as best seen in FIGS. 2 and 3.

Base 50 is machined from a generally rectangular block of steel and includes a floor 51, side walls 52 and 54, a rear wall 55 extending orthogonally to floor 51, a top surface 56 inclined to form an obtuse angle with the surface of back wall 55 of the disc; and an inclined front surface 57 forming an acute angle with the floor surface 51. Formed in the front surface 57 of the base is a concavely curved gullett 58 extending between side walls 52 and 54 and terminating at the top along an edge 58'. Also formed through base 50 is a vertically extending slot 59 (FIG. 3) for receiving therein a wood chipping knife 80 extending vertically midway between sidewalls 52 and 54. Knife 80 includes sharpened edges 82 and is force fitted and held in place by babbitt within slot 59. Base 50 also includes a pair of spaced threaded apertures 53 (FIG. 2) for receiving fastening means for the knife 60. Base 50 further includes a horizontally extending notch 59' (FIG. 1) formed upwardly through floor 51 and substantially parallel with the midway between sidewalls 52 and 54 of the base. Notch 59 serves to lockably receive therein babbitt shimming material 84 positioned between the base 50 and the floor 36 of the cutter disc as best seen in FIG. 2.

Figure 4:
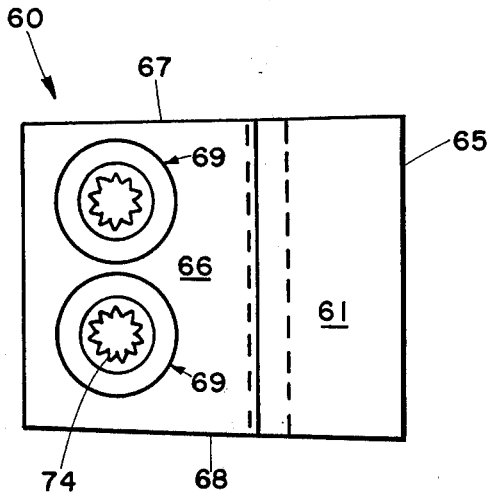
FIG. 4 is a top plan enlarged view of a knife embodying the present invention together with its fastening means.

In order to provide the desired strength and resistance against crushing forces encountered during operation of the cutter, the upper surface 56 of base 50 is inclined upwardly at an angle $\alpha$ from a line L (FIG. 2) parallel to the floor surface 51. The knife 60 is configurated to include angle $\beta$ (which is the compliment of $\alpha$) between its mounting surface 62 and rear mounting surface 64 to position the knife edge 65, formed by the convergent intersection of the outer cutting surface 61 and the inner cutting surface 63, at the desired cutting position. Knife 60 further includes a top surface 66 and side walls 67 and 68 which, as best seen in FIG. 4, converge slightly outwardly from the rear toward the front cutting edge 65. Top surface 66 is substantially parallel to mounting surface or floor 62. Knife 60 is rectilinear in construction (i.e. formed and bounded by straight lines) which facilitates its manufacture and enhances its performance.

Figure 5:
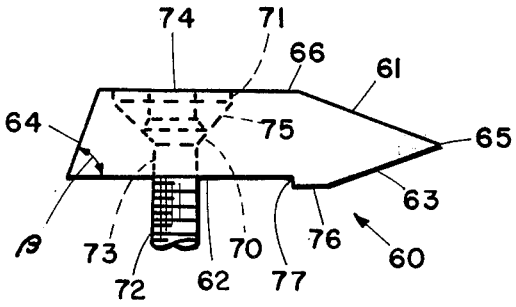
FIG. 5 is a front elevational view of the knife shown in FIG. 4.

Formed downwardly through the body of knife 60 is a pair of conically tapered apertures 69 spaced from one another. As best seen in FIG. 5, the conical apertures 69 receive the correspondingly tapered heads 70 of a fastening bolts 72 which includes a fluted cap 74 (FIG. 4). Apertures 69 include a circular recessed upper portion 71 and a cylindrical lower segment 73 between which a conical taper 75 is provided. The tapered apertures and bolt heads engage one another during attachment of the knife to the base to provide self-alignment of the knife in predetermined position on the upper surface 56 of base 50 with the rear mounting surface 64 positioned as seen in FIGS. 2 and 3 in contact and against the surface 55 of the cutting disc. The conically tapered surface 70 also prevents stress concentrations which could otherwise occur in the knife if a conventional stepped countersink were employed.

Between the mounting surface 62 and inner cutting surface 63 of knife 60 there is provided a grinding guide 76 which has an outer surface parallel to mounting surface 62 and at its trailing edge defines a step 77 which, as best seen in FIG. 2, overlies the junction of gullett 58 and upper surface 56 of base 50 with the mounting surface 62 of knife 60. The grinding guide 76 thus protects this linear interface from chips becomming jammed between the base and knife during operation of the cutter. The grinding guide 76 also provides a visual reference surface when the removable knife is being sharpened by parallel removal of material from surfaces 61 and 63. Thus, once surface 76 has been totally ground away, the operator can readily ascertain that the knife is no longer usable and it is replaced.

Clamp 90 for holding the knife assembly in place on the disc includes a body 92 having outwardly and downwardly extending legs 94 and 96 (FIG. 2) which have face surfaces 95 and 97 respectively. Body 92 includes a central aperture 98 for receiving a threaded stud 99 therein with one end of stud 99 threadably secured to the disc within threaded aperture 88. A nut 100 and lock washer 101 secure the clamp 90 with surface 94 compressively engaging inclined surface 57 of base 50 and surface 97 compressively engaging surface 39 of the disc to thereby compressively hold the knife assembly including base 50 and knife 60 downwardly against floor 36 and rearwardly against wall 35 of the disc. Inclined surface 57 thus transmits the force from clamp 95 in both rearwardly and downwardly directions as can be seen in FIG. 2.

By providing an inclined upper surface 56 to the base 50 and an acute angle between the rear mounting surface and mounting surface of the knife 60, together with the replaceable knife element, several advantages are achieved. Initially, such rectilinear construction of the knife with the parallel top and mounting surfaces provide maximum strength which together with the angled base mounting surface provide resistance against crushing by the extremely high forces encountered by the cutter while in operation. The relatively small knife 60 can economically be manufactured of high quality knife steel such as commercially available A-8 steel modified to include 8.5% by weight chrome and 1.25% by weight of tungsten. The disposable base can be manufactured of a less expensive grade steel thereby significantly reducing the cost of the knife assembly which at the same time resists wear significantly better than the conventional integral knife and base typically made of a lesser grade of steel. Also, due to the fact that relatively inexpensive base material can be provided with a high quality knife portion, it is economical to simply replace the base with a new base instead of grinding the gulletts, thereby eliminating the costly step of machining the gulletts when the knife blade is sharpened.

Field tests of the preferred embodiment described and disclosed herein indicate that profile cutters embodying the present invention are much quieter in operation due to the fact that the replaceable knife, which need not be ground as often, has relatively uniform gulletts in the bases and therefore the machine is balanced better than conventional machines which can have gulletts of varying shapes due to their successive grinding. By employing the relatively high quality steel in the knife itself, the blades have lasted three times or more longer than the normal knife blade and thus machine operation without shutdown for knife sharpening or replacement is greatly extended. Further, by providing a replaceable knife the existing base and babbitt need not be replaced each time the knife needs sharpening or replacement. The grinding guide for the knife provides the machinery operator a simple visual check of whether or not the knife blade can again be sharpened or must be replaced. In a preferred embodiment of the invention, it was discovered that an angle $\alpha$ of from 15° to 22° with the corresponding complimentary angle $\beta$ of 75° to 68° respectfully, provided the maximum performance and durability of the knife assembly including the knife and base.

It will become apparent to those skilled in the art that various modifications to the preferred embodiment described and disclosed herein can be made without departing from the spirit or scope of the invention as defined by the appended claims.

The embodiments of the invention in which an exclusive property or privilege is claimed are defined as follows:

1. A knife assembly for attachment to a cutter disc of a profile cutter machine comprising:

a base having side walls, a floor, and front and rear surfaces, said floor and rear surfaces employed for seating against a chipper disc, said base also including an inclined planar top surface extending downwardly from said front surface toward said rear surface, said base further including means for receiving fastening means;

a rectilinear knife comprising a body having side walls, an upper surface and a mounting surface opposite said upper surface, said mounting surface in contact with said top surface of said base when said knife is positioned on said base, said knife also including a rear mounting surface extending between said side walls and between said upper and mounting surfaces at one end said rear mounting surface shaped for seating against a chipper disc, and a cutting edge extending between said side walls and between said upper and mounting surfaces at an end opposite said rear mounting surface wherein said mounting and said rear mounting surfaces of said knife are substantially co-planar with said top surface and said rear surface respectively of said base when said knife is positioned on said base; and fastening means extending between said knife and said receiving means of said base for removably securing said knife to said base.

2. The apparatus as defined in claim 1 wherein said upper and mounting surfaces of said knife are planar and lie in planes substantially parallel to one another.

3. The apparatus as defined in claim 2 wherein said knife further includes a grinding guide extending between said mounting surface said cutting edge for providing a visual indication of the wear condition of the knife.

4. The apparatus as defined in claim 3 wherein said grinding guide comprises a section of material extending outwardly from said mounting surface to define a ledge at the junction of said grinding guide and said mounting surface.

5. The apparatus as defined in claim 4 wherein said receiving means comprises a pair of spaced threaded apertures formed in said base and wherein said knife includes a pair of spaced apertures aligned with said threaded apertures when said knife is positioned in said base, said spaced apertures including at least a conically tapered side wall position and wherein said fastening means comprise bolts having head means conically tapered to cooperate with said spaced apertures.

6. The apparatus as defined in claim 5 wherein said side walls of said knife diverge from one another from said rear mounting surface toward said cutting edge.

* * * * *

UNITED STATES PATENT AND TRADEMARK OFFICE

CERTIFICATE OF CORRECTION

PATENT NO. : 4,151,869

DATED : May 1, 1979

INVENTOR(S) : John E. Halloran; Leward N. Smith

It is certified that error appears in the above-identified patent and that said Letters Patent are hereby corrected as shown below:

Abstract, line 3:
"gullett" should be -- gullet --

Column 1, line 18:
"gullett" should be -- gullet --

Column 1, line 26:
"clipping" should be -- chipping --

Column 1, line 31:
"gullett" should be -- gullet --

Column 1, line 32:
"gullett" should be -- gullet --

Column 1, line 35:
"gullett" should be -- gullet --

Column 1, line 44:
"gullett" should be -- gullet --

Column 1, line 62:
"knifes" should be -- knives --

Column 1, line 64:
"knifes" should be -- knives --

Column 1, line 67:
"knifes" (two occurrences) should be -- knives --

Column 2, line 35:
"assmebly" should be -- assembly --

UNITED STATES PATENT AND TRADEMARK OFFICE

CERTIFICATE OF CORRECTION

PATENT NO. : 4,151,869

DATED : May 1, 1979

INVENTOR(S) : John E. Halloran; Leward N. Smith

It is certified that error appears in the above-identified patent and that said Letters Patent are hereby corrected as shown below:

Column 2, line 67:
"counter clockwise" should be -- counterclockwise --

Column 3, line 18:
"configured" should be -- configurated --

Column 3, line 22:
"operture" should be -- aperture --

Column 3, line 37:
"gullett" should be -- gullet --

Column 3, line 48:
"the" (second occurrence) should be -- and --

Column 4, line 6:
after "of" delete -- a --

Column 4, line 7:
"includes" should be -- include --

Column 4, line 25:
"gullett" should be -- gullet --

Column 4, lines 27 and 28:
"becomming" should be --becoming --

Column 4, line 43:
"94" should be -- 95 --

Column 4, line 49:
"95" should be -- 90 --

UNITED STATES PATENT AND TRADEMARK OFFICE

CERTIFICATE OF CORRECTION

PATENT NO. : 4,151,869

DATED : May 1, 1979

INVENTOR(S) : John E. Halloran; Leward N. Smith

It is certified that error appears in the above-identified patent and that said Letters Patent are hereby corrected as shown below:

Column 4, line 58:
"provide" should be -- provides --

Column 5, line 4:
"gulletts" should be -- gullets --

Column 5, line 6:
"gulletts" should be -- gullets --

Column 5, line 12:
"gulletts" should be -- gullets --

Column 5, line 14:
"gulletts" should be -- gullets --

Column 5, line 30:
"respectfully" should be -- respectively --

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*